US011640869B2

(12) United States Patent
Kojima

(10) Patent No.: US 11,640,869 B2
(45) Date of Patent: May 2, 2023

(54) BONDING STRUCTURE OF A SHEET CORE AND A PAIR OF FLANGE PARTS OF A COIL COMPONENT

(71) Applicant: TAIYO YUDEN CO., LTD., Tokyo (JP)

(72) Inventor: Tsutomu Kojima, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 249 days.

(21) Appl. No.: 17/093,169

(22) Filed: Nov. 9, 2020

(65) Prior Publication Data

US 2021/0074462 A1 Mar. 11, 2021

Related U.S. Application Data

(63) Continuation of application No. 15/925,583, filed on Mar. 19, 2018, now Pat. No. 10,867,736.

(30) Foreign Application Priority Data

Mar. 31, 2017 (JP) ..... JP2017-071219

(51) Int. Cl.
*H01F 27/30* (2006.01)
*H01F 17/04* (2006.01)
(Continued)

(52) U.S. Cl.
CPC ..... *H01F 17/045* (2013.01); *H01F 27/266* (2013.01); *H01F 27/29* (2013.01);
(Continued)

(58) Field of Classification Search
CPC ..... H01F 17/045; H01F 27/266; H01F 27/29; H01F 27/292; H01F 27/30; H01F 41/0246; H01F 2017/0093
See application file for complete search history.

(56) References Cited

U.S. PATENT DOCUMENTS 6,242,996 B1 * 6/2001 Sato ..... H01F 17/045 336/200
6,373,366 B1 * 4/2002 Sato ..... H01F 27/292 336/200
(Continued)

FOREIGN PATENT DOCUMENTS

JP H04105520 U 9/1992
JP 2007142931 A 6/2007
(Continued)

OTHER PUBLICATIONS

A Notification of Reasons for Refusal issued by the Japanese Patent Office, dated Feb. 5, 2019 for related Japanese application No. 2017-071219 (12 pages).
(Continued)

*Primary Examiner* — Tuyen T Nguyen
(74) *Attorney, Agent, or Firm* — Law Office of Katsuhiro Arai

(57) ABSTRACT

A bonding structure of a sheet core and a pair of flange parts wherein the pair of flange parts is formed on both ends of a shaft part to constitute a drum core together with the shaft part; the sheet core is bonded, in a manner connecting the pair of flange parts across the shaft part, to the top faces of the flange parts facing away from the bottom faces of the flange parts to be mounted on a circuit board; and a coil-shaped conductor is constituted by sheathed conductive wires wound around the shaft part; wherein the bonding surfaces of each of the flange parts and the sheet core have multiple contact areas where the flange part makes direct contact with the sheet core, as well as adhesive areas between the contact areas where an adhesive is disposed.

13 Claims, 8 Drawing Sheets

(51) Int. Cl.

| | |
|---|---|
| ***H01F 27/29*** | (2006.01) |
| ***H01F 41/02*** | (2006.01) |
| ***H01F 27/26*** | (2006.01) |
| *H01F 17/00* | (2006.01) |

(52) U.S. Cl.
CPC ..... *H01F 27/292* (2013.01); *H01F 27/30* (2013.01); *H01F 41/0246* (2013.01); *H01F 2017/0093* (2013.01)

(56) References Cited

U.S. PATENT DOCUMENTS

| | | | | |
|---|---|---|---|---|
| 7,567,163 | B2 | 7/2009 | Dadafshar et al. | |
| 9,905,355 | B2 | 2/2018 | Takagi et al. | |
| 2003/0071704 | A1* | 4/2003 | Toi ..... | H01F 27/36 336/83 |
| 2007/0159289 | A1 | 7/2007 | Lee et al. | |
| 2008/0224813 | A1 | 9/2008 | Hirai et al. | |
| 2011/0121935 | A1 | 5/2011 | Chu et al. | |
| 2012/0133469 | A1 | 5/2012 | Tomonari et al. | |
| 2015/0084731 | A1 | 3/2015 | Takagi et al. | |
| 2017/0025212 | A1 | 1/2017 | Jerez et al. | |
| 2017/0229227 | A1 | 8/2017 | Igarashi | |
| 2019/0244744 | A1 | 8/2019 | Takenaka et al. | |
| 2019/0287710 | A1 | 9/2019 | Igarashi et al. | |
| 2020/0066435 | A1 | 2/2020 | Igarashi et al. | |

FOREIGN PATENT DOCUMENTS

| | | | |
|---|---|---|---|
| JP | 2009224649 | A | 10/2009 |
| JP | 2009259991 | A | 11/2009 |
| JP | 2012119568 | A | 6/2012 |
| JP | 2014099586 | A | 5/2014 |
| JP | 2014099587 | A | 5/2014 |
| JP | 2015032643 | A | 2/2015 |
| JP | 2015065272 | A | 4/2015 |
| JP | 2016035972 | A | 3/2016 |
| JP | 2017005079 | A | 1/2017 |
| JP | 2017508298 | A | 3/2017 |
| JP | 2017143118 | A | 8/2017 |
| WO | 2007060961 | A1 | 5/2007 |
| WO | 2015135703 | A1 | 9/2015 |

OTHER PUBLICATIONS

A Notification of Reasons for Refusal issued by the Japanese Patent Office, dated Nov. 26, 2019, for related Japanese application No. 2018-185572. (5 pages).

A Notification of Reasons for Refusal issued by the Japanese Patent Office, dated Oct. 2, 2018, for related Japanese application No. 2017-071219 (13 pages).

Non-Final Office Action issued by U.S. Patent and Trademark Office, dated May 5, 2020, for related U.S. Appl. No. 15/925,583 (25 pages).

Notice of Allowance issued by U.S. Patent and Trademark Office, dated Aug. 20, 2020, for related U.S. Appl. No. 15/925,583 (5 pages).

Non-Final Office Action issued by U.S. Patent and Trademark Office, dated May 27, 2022, for a co-pending U.S. Appl. No. 16/572,288 (26 pages).

Final Office Action issued by U.S. Patent and Trademark Office, dated Nov. 21, 2022, for a co-pending U.S. Appl. No. 16/572,288 (18 pages).

* cited by examiner

FIG. 1
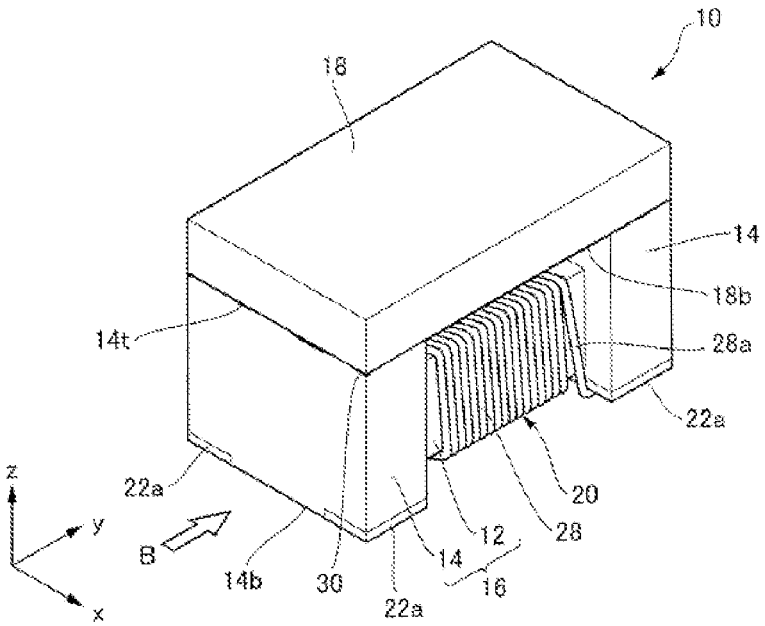
[FIG. 2]
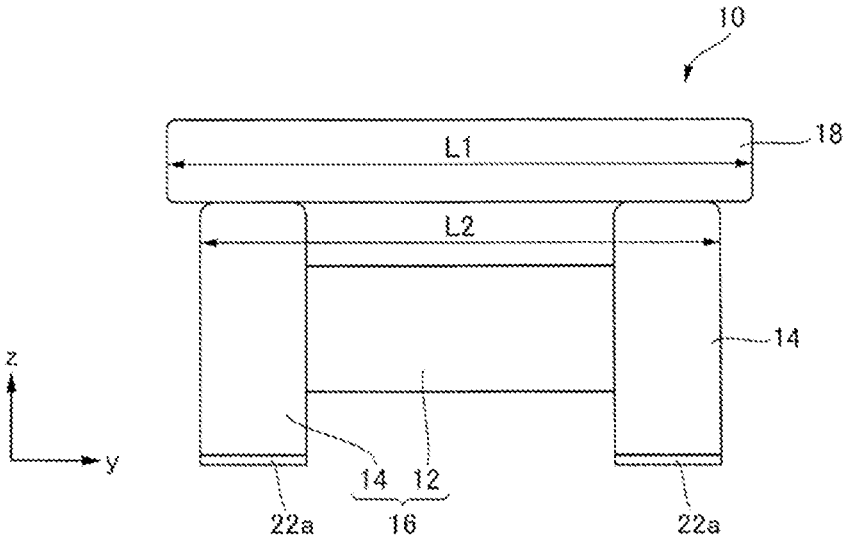

BONDING STRUCTURE OF A SHEET CORE AND A PAIR OF FLANGE PARTS OF A COIL COMPONENT

CROSS-REFERENCE TO RELATED APPLICATIONS

This application is a continuation of U.S. patent application Ser. No. 15/925,583, filed Mar. 19, 2018, which claims priority to Japanese Patent Application No. 2017-071219, filed, Mar. 31, 2017, the disclosure of which is incorporated herein by reference in its entirety including any and all particular combinations of the features disclosed therein.

The applicant herein explicitly rescinds and retracts any prior disclaimers or disavowals or any amendment/statement otherwise limiting claim scope made in any parent, child or related prosecution history with regard to any subject matter supported by the present application.

BACKGROUND

Field of the Invention

The present invention relates to a winding-type common mode choke coil used in various electronic devices, as well as a method for manufacturing such common mode choke coil, and a circuit board.

Description of the Related Art

There has been a demand, in recent years, that common mode choke coils mounted on the circuit boards of mobile devices such as onboard devices have high impact resistance to withstand the impact of dropping, etc. For example, a winding-type common mode choke coil, which is structurally constituted by a drum core and a sheet core, requires stronger bonding of the drum core and the sheet core in order to achieve high impact resistance.

Patent Literature 1 and Patent Literature 2 each disclose a common mode choke coil whose structure is characterized by a drum core and a sheet core bonded together using an adhesive. In Patent Literature 1, grooves are provided on the contact surface between the flange and the sheet core, and an epoxy resin, which serves as an adhesive, is filled in the grooves. These grooves and adhesive allow the cores to securely adhere together, and improve the bonding strength. In Patent Literature 2, a tapered part is provided on the top face of the flange part so that the space between the sheet core and the drum core can be filled with the minimum required amount of adhesive, thereby achieving high bonding strength with a small amount of adhesive.

BACKGROUND ART LITERATURES

[Patent Literature 1] Japanese Patent Laid-open No. 2009-224649

[Patent Literature 2] Japanese Patent Laid-open No. 2014-99587

SUMMARY

To achieve high impact resistance in a winding-type common mode choke coil structurally constituted by a drum core and a sheet core, the bonding strength between the bonding surfaces of the drum core and the sheet core must be increased more effectively. And, to effectively increase the bonding strength between the bonding surfaces of the drum core and the sheet core, it is considered that not only the shape of the bonding surface such as grooves and tapering, but also the properties of the bonding surface such as surface roughness and surface waviness, must be improved.

Here, examples of bonding surfaces on the drum core and the sheet core of a conventional common mode choke coil are shown in FIGS. 10A and 10B.

FIG. 10A shows that, if both the top face 110*t* of the flange part constituting the drum core, and the bottom face 100*b* of the sheet core, have low surface roughness, then the amount of adhesive 120 between the bonding surfaces becomes small, which may cause the bonding strength to drop and impact resistance to decrease. Furthermore, decreasing the amount of adhesive for fear that extra adhesive may ooze out of the bonding surfaces, creates unbonded areas where there is insufficient adhesive, and this causes the bonding strength to drop. On the other hand, FIG. 10B shows that, if both the top face 110*t* of the flange part and the bottom face 100*b* of the sheet core have high surface roughness, then it becomes difficult to achieve a constant thickness of the adhesive 120 between the bonding surfaces. For the reasons mentioned above, the reliability of mechanical strength in terms of impact resistance, and the electrical characteristics such as impedance, both of which are considered important in mobile devices such as onboard devices, may drop.

Accordingly, it is considered necessary to improve not only the shapes, but also the properties, of the bonding surfaces in order to effectively increase the bonding strength between the bonding surfaces of the drum core and the sheet core. It is clear that the object of Patent Literature 1 and Patent Literature 2, where there is no mention of the surface properties of the bonding surfaces of the sheet core and the drum core, is not to improve the bonding strength by means of the surface properties of both cores. Also, increasing the bonding strength alone is not enough, and the electrical characteristics must also be maintained/improved.

An object of the present invention is to provide a common mode choke coil capable of achieving both high bonding strength and excellent inductance characteristics, as well as a method for manufacturing such common mode choke coil.

Any discussion of problems and solutions involved in the related art has been included in this disclosure solely for the purposes of providing a context for the present invention, and should not be taken as an admission that any or all of the discussion were known at the time the invention was made.

In some embodiments, the common mode choke coil proposed by the present invention is characterized in that it comprises: a shaft part; a pair of flange parts formed on both ends of the shaft part to constitute a drum core together with the shaft part; a sheet core bonded, in a manner connecting the pair of flange parts across the shaft part, to the top faces of the flange parts facing away from the bottom faces of the flange parts to be mounted on a circuit board; a coil-shaped conductor constituted by sheathed conductive wires wound around the shaft part; and electrode terminals formed on the flange parts and electrically connected to the ends of the sheathed conductive wires; wherein the bonding surfaces of each of the flange parts and the sheet core have multiple contact areas (predetermined contact areas) where the flange part makes direct contact (no or substantially no materially intervening adhesive or other material therebetween) with the sheet core, as well as adhesive areas (predetermined adhesive areas) between the contact areas where an adhesive is disposed.

The method for manufacturing the common mode choke coil proposed by the present invention is characterized in that it includes: a step to form a drum core and a sheet core; a step to form electrode terminals on the drum core; a step to wind sheathed conductive wires around the drum core to form a coil-shaped conductor; a step to connect both ends of the sheathed conductive wires and the electrode terminals; and a step to apply an adhesive to the sheet core on a jig, install the drum core on the sheet core to which the adhesive has been applied, and stack the jig on which the drum core has been installed with other such jigs, and thereby apply pressure while the adhesive is cured.

According to the present invention, a common mode choke coil capable of achieving both high bonding strength and excellent inductance characteristics, as well as a method for manufacturing such common mode choke coil, can be provided. Additionally, a circuit board using such common mode choke coil can be provided.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1 is a perspective view of an example of a common mode choke coil pertaining to the first embodiment of the present invention.

FIG. 2 is a drawing explaining an example of external dimensions in the first embodiment.

DESCRIPTION OF THE SYMBOLS

Figure 3A:
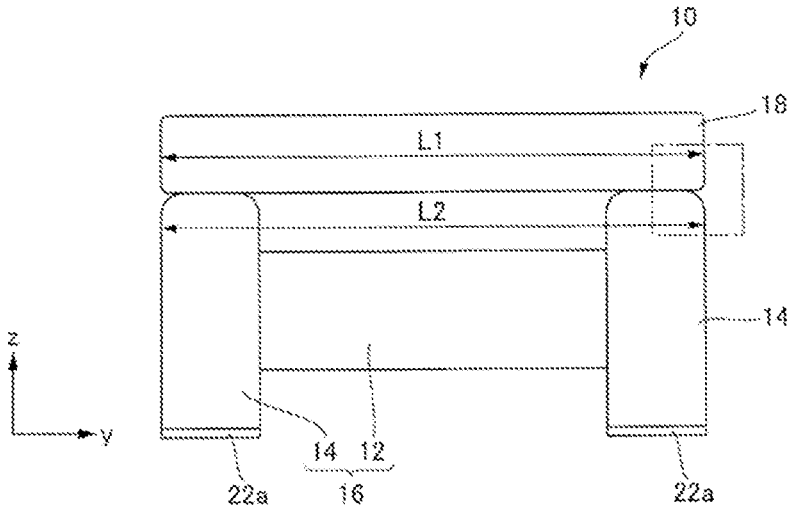
FIG. 3A is a drawing explaining an example of external dimensions in the first embodiment.

10 Common mode choke coil
12 Shaft part
14 Flange part
14*b* Bottom face of flange part
14*t* Top face of flange part (including a bonding surface)
15 Contact area
15*a* First contact area
15*aa* First contact-area center point
15*ab* Contacting region
15*b* Second contact area
15*ba* Second contact-area center point
16 Drum core
18 Sheet core
18*b* Bottom face of sheet core (including a bonding surface)
20 Coil-shaped conductor
22*a*, 22*b* Electrode terminal
28 Sheathed conductive wire
28*a*, 28*b* Lead part
30 Adhesive
30*a* Adhesive area
30*b* First adhesive area

DETAILED DESCRIPTION OF EMBODIMENTS

The common mode choke coils pertaining to embodiments of the present invention are explained below by referring to the drawings. It should be noted that these are only examples and the present invention is not limited to the embodiments illustrated. Characteristic portions of the invention may be emphasized in the drawings, so the scale of each part of the drawings may not necessarily be accurate.

Also, the drawings indicate the xyz coordinate system being a three-dimensional orthogonal coordinate system, as deemed appropriate. In the xyz coordinate system, the x-axis direction represents the circumferential direction of the coil-shaped conductor, running in parallel with the bottom faces of the flange parts to be mounted on a circuit board as shown in FIG. 1. The y-axis direction represents the axial direction of the coil-shaped conductor as shown in FIG. 1. The z-axis direction represents the direction orthogonal to the bottom faces of the flange parts as shown in FIG. 1, which is the direction orthogonal to both the x-axis direction and the y-axis direction.

First Embodiment

<Overall Configuration>

FIG. 1 is a perspective view of an example of a common mode choke coil 10 pertaining to the first embodiment of the present invention. The common mode choke coil 10 in this embodiment has: a drum core 16 constituted by a shaft part 12 and flange parts 14; a sheet core 18; a coil-shaped conductor 20; and electrode terminals 22*a*. Each constitutional member is explained below in detail.

<Drum Core 16 and Sheet Core 18>

As shown in FIG. 1, the drum core 16 comprises the shaft part 12 and the pair of flange parts 14 provided on both ends thereof. The sheet core 18 is provided in a manner connecting the pair of flange parts across the shaft part 12.

The shaft part 12 is not limited to any particular shape so long as there is a region around which the below-mentioned sheathed conductive wires 28 can be wound, but preferably it has a cylindrical shape, prism shape, or other solid shape with a long axis. The flange parts 14 are provided on both ends of the shaft part 12, respectively, and have a quadrangular, sheet-shaped structure of a specified thickness. Preferably the quadrangular shape is a rectangle with long sides and short sides. The flange parts 14 each have a bottom face 14*b* to be mounted on a circuit board (not illustrated), side faces joined to the bottom face 14*b*, and a top face 14*t* facing the sheet core 18 and bonded to it by an adhesive 30.

Preferably both long-axis ends of the shaft part 12 abut the centers of the quadrangular shapes constituting the flange parts 14. It should be noted that the shaft part 12 and flange parts 14 may be constituted as one piece.

The sheet core 18 is not limited to any particular shape, but preferably it has a quadrangular, sheet-shaped structure of a specified thickness. Also, preferably the quadrangular shape is a rectangle with long sides and short sides. The sheet core 18 has a bottom face 18*b* facing the top faces 14*t* of the flange parts and bonded to them by an adhesive 30.

The bonding surfaces on the top face 14*t* of the flange part and the bottom face 18*b* of the sheet core have multiple contact areas 15 which are provided on the bonding surface on the flange part side (top face 14*t* of the flange part) and where the bottom face 18*b* of the sheet core makes direct contact with the top face 14*t* of the flange part, as well as adhesive areas 30*a* which are provided on the bonding surface excluding the contact areas 15 and where an adhesive 30 is disposed; the details of these areas are described separately in detail below.

For the material of the drum core 16 and sheet core 18, Ni—Zn—Cu ferrite, Mn—Zn—Cu ferrite, etc., may be used, for example. Choices are not limited to the foregoing, however, and any alloy-based magnetic material (such as Fe—Cr—Si alloy, Fe—Al—Si alloy, etc.) may also be used. The drum core 16 and sheet core 18 may each be formed by mixing any such magnetic material with a binder and then pressure-molding the mixture into a drum shape using dies, followed by sintering, etc. For the modes, manufacturing methods, and other aspects of the drum core 16 and sheet core 18 in this embodiment, any prior art or the below-mentioned example may be referenced as deemed appropriate. An example of a manufacturing method is also described below.

FIG. 2 presents a drawing explaining an example of external dimensions of the common mode choke coil 10. The external dimensions of the sheet core 18 are not limited in any way, but preferably, as shown in FIG. 2, the external dimension L1 of the sheet core 18 in the long direction (y-axis direction) of the sheet core 18 is greater than the external dimension L2 of the drum core 16. For example, the external dimension L1 of the sheet core 18 in the long direction is greater than the external dimension L2 of the drum core 16 by approx. 0.1 to 0.2 mm.

This constitution allows the sheet core 18 to absorb any displacement resulting from its bonding with the drum core 16, and thus eliminates any negative effect attributable to the accuracy of the bonded positions, or in other words suppresses any change in the size of the bonding surface, of the sheet core 18 and the drum core 16, which in turn makes the electrical characteristics of the common mode choke coil 10 stable. In addition, the foregoing constitution also minimizes any negative effect attributable to the forming accuracy of the drum core 16 and sheet core 18 by, for example, reducing any negative effect from burrs that generate when the drum core 16 and sheet core 18 are formed. This means that, even when burrs generated at the time of forming remain on the sheet core 18, or even when the edges of the bottom face 18*b* of the sheet core are rounded, the areas of the bonding surfaces of the drum core 16 and the sheet core 18 can be made constant. It should be noted that, while FIG. 2 explains the external dimensions L1, L2 of the sheet core and drum core in the long direction of the sheet core, respectively, the external dimension of the sheet core 18 in the short direction (x-axis direction in FIG. 1) of the sheet core 18 may be greater than the external dimension of the drum core 16 (not illustrated). This is because the same operations and effects achieved in the long direction, can also be achieved in the short direction, of the sheet core 18. Furthermore, the external dimensions of the sheet core 18 in both the long direction and short direction may be greater than the external dimensions of the drum core 16 in the same directions.

Figure 3B:
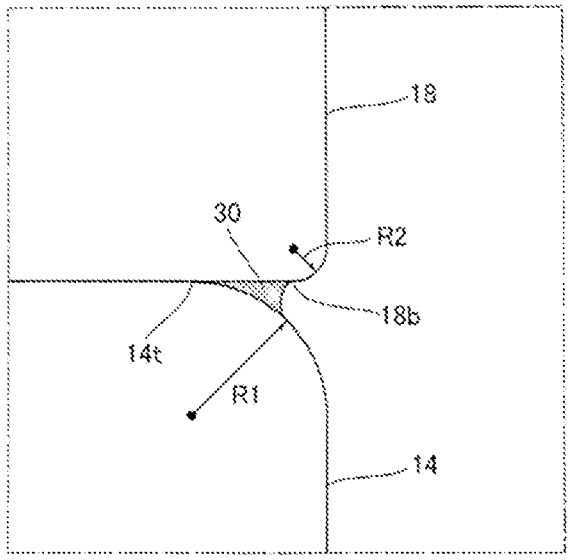
FIG. 3B is an enlarged view of FIG. 3A, explaining examples of radius dimensions of the flange part and sheet core in the first embodiment.

FIG. 3A presents a drawing that explains an example of external dimensions of the common mode choke coil 10. FIG. 3B shows an enlarged view of the area in FIG. 3A surrounded by the dashed-dotted line.

As shown in FIG. 3A, when the external dimension L1 of the sheet core 18 in the long direction of the sheet core is roughly the same as the external dimension L2 of the drum core 16, preferably the corners at the end of the top face 14*t* of the flange part and the end of the bottom face 18*b* of the sheet core are both rounded, where the radius dimension R1 of the rounded shape of the top face 14*t* of the flange part in the long direction of the sheet core is greater than the radius dimension R2 of the rounded shape of the bottom face 18*b* of the sheet core. It should be noted that, in this Specification, the term "rounded shape" indicates a curved shape of a corner in a cross-sectional view. Also, the term "radius dimension" indicates the radius dimension of a curved line on a curved plane. More preferably the difference between the external dimensions of the sheet core 18 and drum core 16 is greater than the radius dimension R1 of the rounded shape of the flange part.

This constitution allows the adhesive 30 bonding the top face 14*t* of the flange part and the bottom face 18*b* of the sheet core, to wet and spread over the rounded shapes in a manner preventing the adhesive 30 from oozing out, the result of which is that, even when the external dimension of the sheet core varies relative to the external dimension of the drum core due to a manufacturing error, etc., the sheet core 18 and the drum core 16 flange can still be maintained in a well-bonded state without an excessive amount of adhesive 30 remaining and generating magnetic gaps in between, or an excessive amount of adhesive 30 attaching to the sheathed conductive wires 28 and causing the stray capacitance between the conductive wires to vary. For the modes, manufacturing methods, and other aspects of the rounded shapes in this embodiment, any prior art or the below-mentioned example may be referenced as deemed appropriate. For example, the rounded shapes in this embodiment may be formed by grinding down the corners on the outer periphery of the core, or the like. Also, they can be formed by pre-shaping the corners into arc-shaped curved lines when the core is formed, for example.

<Coil-Shaped Conductor 20>

The coil-shaped conductor 20 is provided on the outer periphery of the shaft part 12 and constituted by two sheathed conductive wires 28 wound in the same winding direction by the same number of turns. At the ends of the sheathed wires 28 are lead parts 28*a* that have been led out from the coil. For the method for winding the sheathed conductive wires 28, any generally used winding method, such as bifilar winding or layer winding, may be selected as deemed appropriate.

Preferably the coil-shaped conductor 20 in this embodiment is such that the sheathed conductive wires 28 constituting the coil-shaped conductor 20 are separate from the bonding surfaces of the drum core 16 and the sheet core 18. In other words, the adhesive 30 between the bonding surfaces should be positioned away from the sheathed conductive wires 28 by a sufficient distance to prevent contact.

This constitution prevents any negative effect the adhesive 30 may have on the sheathed conductive wires 28. Here, "negative effect" means stressing of the sheathed conductive wires 28 due to volume shrinkage of the adhesive 30 when the adhesive is cured, or change in the stray capacitance between the sheathed conductive wires due to a chemical reaction of the components of the adhesive and sheathed conductive wire and due to the adhesive 30, for example.

For the specific manufacturing method and other aspect of the coil-shaped conductor 20, any prior art or the descriptions below may be referenced as deemed appropriate. An example of a manufacturing method is also described below.

<Electrode Terminal 22*a*>

Two electrode terminals 22*a* are provided, one on each flange part 14, and electrically connected to the lead parts 28*a* at the ends of the sheathed conductive wires 28. In FIG. 1, the electrode terminals 22*a* are provided on the bottom faces 14*b* of the flange parts; however, the present invention is not limited to the foregoing, and they may also be provided on side faces of the flange parts 14 as described in the variation examples below.

For the specific shape, manufacturing method, and other aspects of the electrode terminals 22*a*, any prior art or the description below may be referenced as deemed appropriate, and a typical manufactured method is based on plating. An example of a manufacturing method is also described below.

(Bonding Surfaces in First Embodiment)

The bonding surfaces of the drum core 16 and the sheet core 18 in this embodiment are explained below. As described above, the drum core 16 and the sheet core 18 are bonded together by the adhesive 30, with the top faces 14*t* of the flange parts constituting the drum core facing the bottom face 18*b* of the sheet core.

Figure 4:
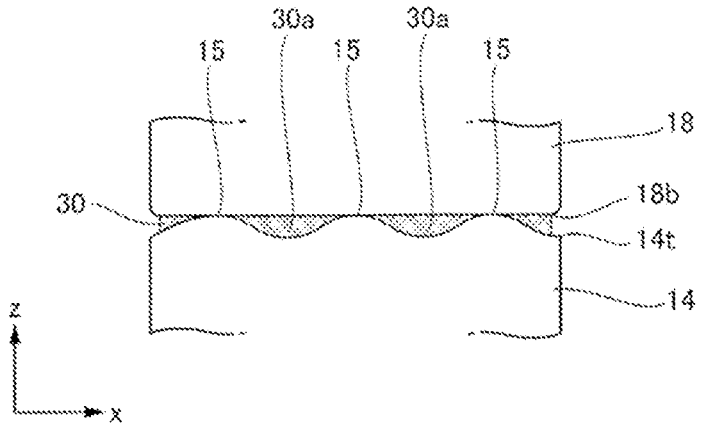
FIG. 4 is a drawing showing an example of bonding surfaces pertaining to the first embodiment.

FIG. 4 shows an example of bonding surfaces on the top face 14*t* of one flange part, and the bottom face 18*b* of the sheet core, of the common mode choke coil 10 in FIG. 1 as viewed from the direction of arrow B. As shown in FIG. 4, the bonding surfaces on the top face 14*t* of the flange part and the bottom face 18*b* of the sheet core have multiple, or at least two, contact areas 15 which are provided on the bonding surface on the flange part side and where the top face 14*t* of the flange part makes direct contact with the bottom face 18*b* of the sheet core, as well as adhesive areas 30*a* which are provided on the bonding surface excluding the contact areas 15 and where an adhesive 30 is disposed. It should be noted that the bonding surface of the top face 14*t* of the other flange part and that of the bottom face 18*b* of the sheet core have the same structure (not illustrated) as the one shown in FIG. 4.

Each contact area 15 has a projecting shape that projects from the top face 14*t* of the flange part, as shown in FIG. 4; however, the contact area is not limited to this shape and can have any other shape so long as the bottom face 18*b* of the sheet core is contacted. As for the adhesive area 30*a*, the shape of the adhesive area 30*a* generates according to the projecting shape of the top face 14*t* of the flange part in the contact area 15, and in this embodiment, the shape of the adhesive area 30*a* is not limited in any way.

Figure 10A:
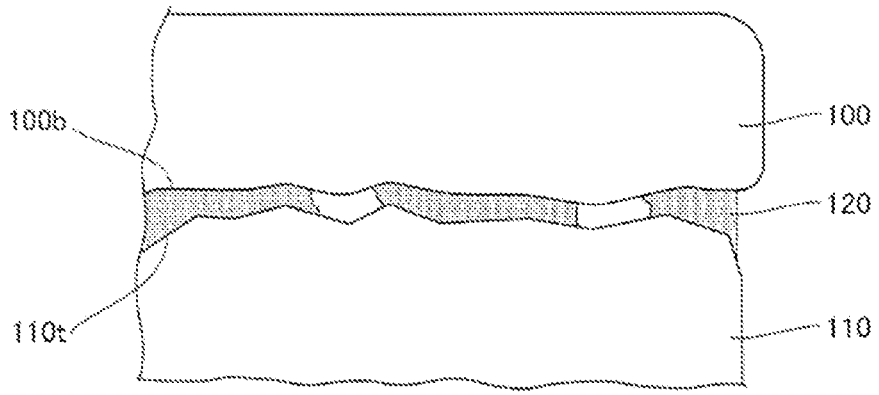
FIG. 10A Background Art
FIG. 10A is a drawing showing an example of conventional bonding surfaces.
Figure 10B:
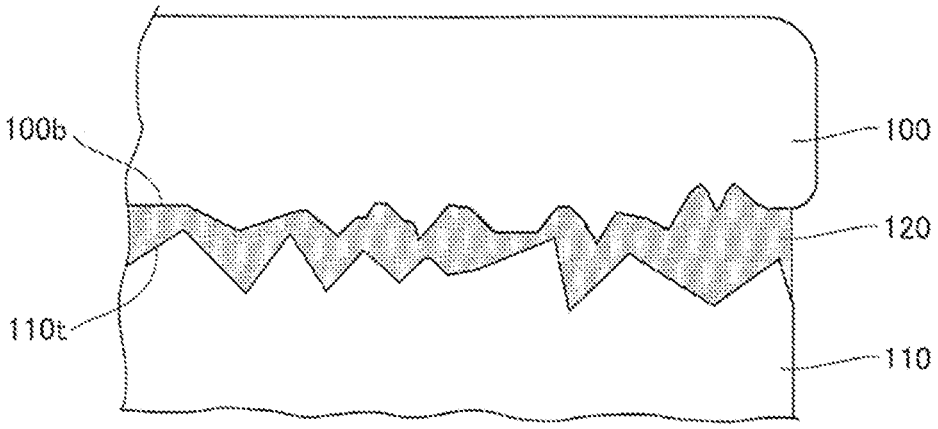
FIG. 10B Background Art
FIG. 10B is a drawing showing an example of conventional bonding surfaces.

FIG. 4 shows three contact areas 15; however, the number of contact areas 15 is not limited to three, so long as there are at least two such areas on the bonding surface of the flange part 14. This constitution having multiple contact areas 15 improves/stabilizes the bonding strength compared to the conventional common mode choke coils shown in FIGS. 10A and 10B where the adhesive is applied over the entire surface. The common mode choke coil shown in FIG. 10A has lower bonding strength because the adhesive 120 is applied by a smaller amount. Also, when the adhesive 120 is applied by an amount just sufficient to not generate excess, it may turn out that the adhesive 120 is insufficient and unbonded areas may be created as a result. With the common mode choke coil shown in FIG. 10B, controlling the amount of adhesive to an optimal level is difficult because the thickness of the adhesive area varies locally. For this reason, the amount of adhesive 120 tends to become excessive in some areas and insufficient in other areas. As a result, stable bonding strength is not achieved in FIG. 10A or FIG. 10B. Furthermore, the constitution having multiple contact areas 15 reduces the negative effect caused by varying magnetic gaps due to the adhesive layer, compared to the conventional common mode choke coils shown in FIGS. 10A and 10B where the adhesive is applied over the entire surface. This means that the common mode choke coil 10 in this embodiment offers superior inductance characteristics.

The multiple contact areas 15 in this embodiment may be formed by pre-forming tapered or other projecting areas on the top faces 14*t* of the flange parts when the drum core 16 is formed; however, preferably they are formed by grinding the top faces 14*t* of the flange parts, etc. Here, in this Specification, the surface properties of the drum core 16 and sheet core 18 are expressed by surface roughness Ra (arithmetic average roughness) and surface waviness Wa (arithmetic average waviness).

Surface roughness Ra (arithmetic average roughness) and surface waviness Wa (arithmetic average waviness) are specified in JIS B 0601, respectively. In this Specification, surface roughness Ra is defined as a surface property associated with an amplitude value of less than 10 μm, while surface waviness Wa is defined as a surface property associated with an amplitude value of 10 μm or more, with a cutoff value of 200 μm.

Presence of contact areas 15 can be confirmed by grinding a cross-section and observing it with an optical microscope, etc., and distances can also be measured using any length measurement function as deemed appropriate. Contact areas 15 may be specified using a three-dimensional X-ray inspection machine, etc., or the ground cross-section may be determined using such machine in a supplementary manner.

Preferably the surface waviness Wa of the bonding surface of the flange part 14 is greater than the surface waviness Wa of the bonding surface of the sheet core 18. This constitution allows the bonding surfaces, or specifically the top face 14*t* of the flange part and the bottom face 18*b* of the sheet core, to make direct contact with each other in a reliable manner via multiple contact areas 15. This makes it possible to control the amount of adhesive 30 and thereby improve/stabilize the bonding strength by applying more adhesive in a stable manner, whereas, heretofore, the amount of adhesive 30 could not be increased in the interest of preventing excess adhesive 30. In addition, preferably the bonding surface of the sheet core 18 does not have surface waviness Wa. Furthermore, preferably the surface waviness of the bonding surface of the flange part 14 is 25 μm or less. When the surface waviness of the bonding surface of the flange part 14 is 25 μm or less, effectively no magnetic gaps will form and the inductance characteristics will improve further.

According to the conventional structure where the bonding surfaces, or specifically the top face 14*t* of the flange part and the bottom face 18*b* of the sheet core, do not make direct contact with each other in a reliable manner via multiple contact areas 15, controlling the thickness of adhesive is difficult because it cannot be determined by the shapes of members and is instead affected by the amount of adhesive, surface roughness, waviness and other surface irregularities that vary in each circumstance. If the thickness of adhesive exceeds 25 μm even in only some areas, it effectively serves as a magnetic gap and the inductance characteristics fluctuate as a result. On the other hand, this structure where the bonding surfaces, or specifically the top face 14*t* of the flange part and the bottom face 18*b* of the sheet core, make direct contact with each other in a reliable manner via multiple contact areas 15, the thickness of adhesive can be controlled by applying proper pressure when the drum core 16 and sheet core 18 are bonded together, and thereby forming contact areas 15 in a reliable manner. This makes it possible to design a thickness of adhesive to become 25 μm or less so as to effectively create substantially no magnetic gaps, which in turn achieves good inductance characteristics.

Variation Examples of First Embodiment (Variation Example Characterized by Grooves Provided in Sheet Core 18)

Figure 5:
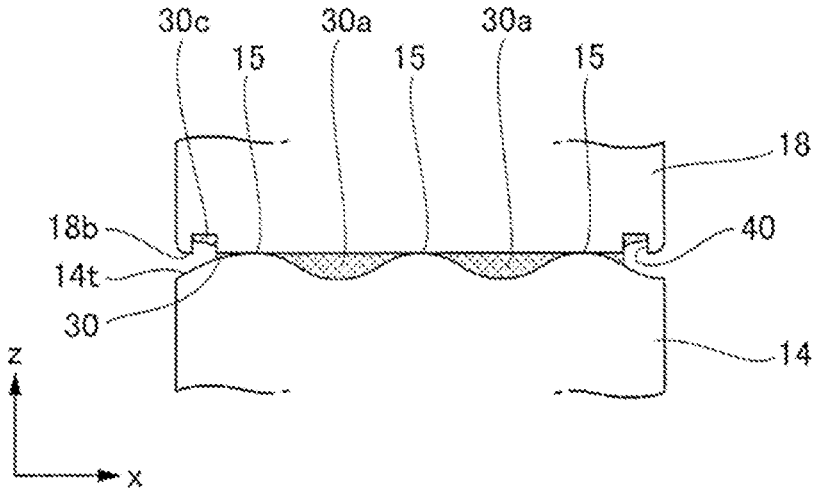
FIG. 5 is a drawing showing an example of a sheet core pertaining to a variation example of the first embodiment.

The common mode choke coil 10 pertaining to the first embodiment, as shown in FIG. 1, represents an example where the bonding surface of the sheet core 18 is roughly flat. However, the sheet core 18 is not limited to this structure and, for example, one or more grooves 40 may be provided in the bonding surface of the sheet core 18, as shown in FIG. 5. The groove 40 may be a straight groove or circular groove. In other words, the grooves 40 need to provide only enough space to accommodate the excess adhesive 30*c* not involved in the bonding by the adhesive 30, and the number of grooves and shape of grooves are not limited. Preferably the volume of the grooves 40 is the same as or greater than the volume of the adhesive that has cured on the bonding surface. Also, the pitch, dimensions, etc., of the grooves 40 need not be constant and, for example, the grooves 40 may be made shallower toward the edges of the sheet core 18.

According to this variation example, the amount of adhesive involved in the bonding becomes always constant without being excessive or insufficient because, even when the adhesive 30 is applied by an excessive amount in the below-mentioned step to apply the adhesive 30, the excess adhesive 30 will flow into the grooves 40 and the bonding strength will improve/stabilize as a result. Furthermore, any negative effect of the adhesive 30 attaching to the sheathed conductive wires 28 can be avoided. Here, "negative effect" means stressing of the sheathed conductive wires 28 due to volume shrinkage of the adhesive 30 when the adhesive is cured, or change in the stray capacitance between the sheathed conductive wires due to a chemical reaction of the components of the adhesive and sheathed conductive wire and due to the adhesive 30, for example. As described above, preferably the volume of the grooves 40 is the same as or greater than the volume of the adhesive that has cured on the bonding surface. This constitution achieves the aforementioned effects in a more reliable manner. It should be noted that, while the illustrated example explains forming of grooves 40 in the bonding surface of the sheet core 18, grooves 40 may also be formed in the bonding surface of the flange part 14, or grooves 40 may even be formed in both the bonding surfaces of the sheet core 18 and the flange part 14.

(Variation Example Characterized by Electrode Terminals 22*b* Provided in Side Grooves 32 of Flange Parts 14)

The common mode choke coil 10 pertaining to the first embodiment, as shown in FIG. 1, represents an example where the electrode terminals 22*a* are provided on the bottom faces 14*b* of the flange parts. However, the present invention is not limited to this structure and, for example, the electrode terminals 22*b* may be provided in side grooves 32, which are grooves formed on the side faces of the flange parts 14, as shown in FIG. 6.

Figure 6:
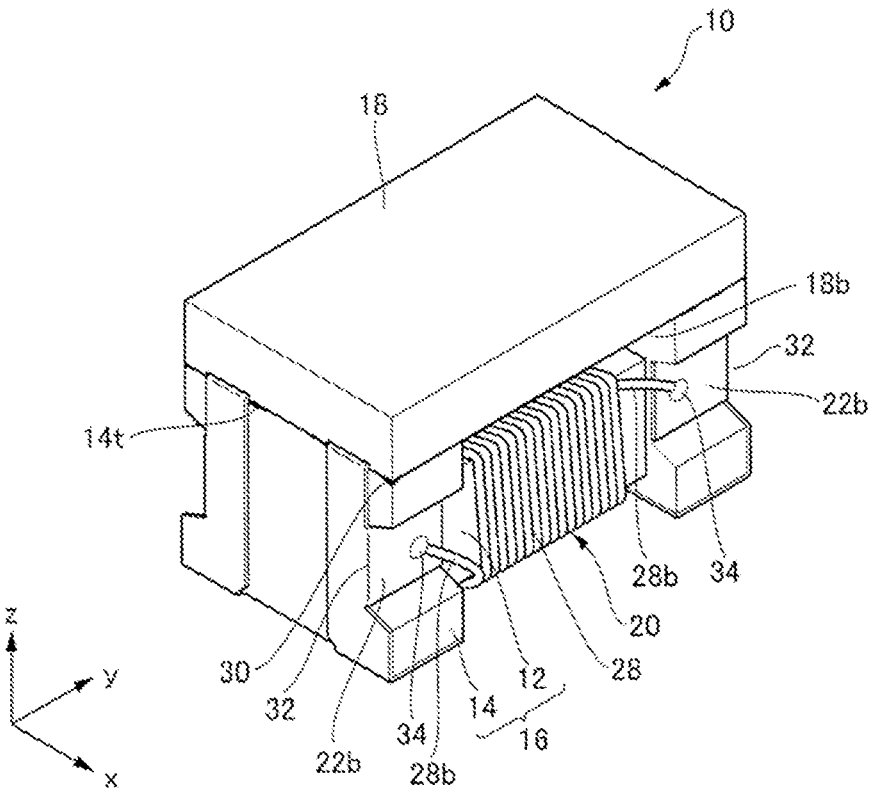
FIG. 6 is a perspective view showing an example of a common mode choke coil pertaining to a variation example of the first embodiment.

The positions of the side grooves 32 are not limited in any way, and may be provided roughly at the centers of the flange parts in the z-axis direction, as shown in FIG. 6, for example. In this variation example, the electrode terminals 22*b* are positioned inside the side grooves 32 and connected to the lead parts 28*b* at the ends of the sheathed conductive wires 28. It should be noted that, since the ends of the lead parts 28*b* are connected to the electrode terminals 22*b* by means of thermal bonding, etc., FIG. 6 shows connection parts 34 where the electrode terminals 22*b* are connected to the ends of the lead parts 28*b*.

According to this variation example, contact between the lead parts 28*b* and the adhesive 30 can be prevented because the lead parts 28*b* are away from the adhesive 30 on the bonding surface. Also, the stray capacitance of the common mode choke coil 10 is suppressed and thermal stress is not applied to the lead parts 28*b*. Furthermore, traveling of the adhesive 30 along the lead parts 28*b* can be prevented.

Also, the center position of the side groove 32 in the z-axis direction may be the same as the center height position of the flange part 14. This way, the top side, and the bottom side, of the side face of the flange part 14, except for the side groove 32, have the same dimensions, and consequently mechanical strength can be achieved in these areas. Furthermore, the center position of the shaft part 12 in the z-axis direction can also be the same as the center height position of the flange part 14. This way, any risk of damage to the coil-shaped conductor 20 due to handling after the sheathed conductive wires 28 have been wound, can be reduced.

Second Embodiment

Figure 7A:
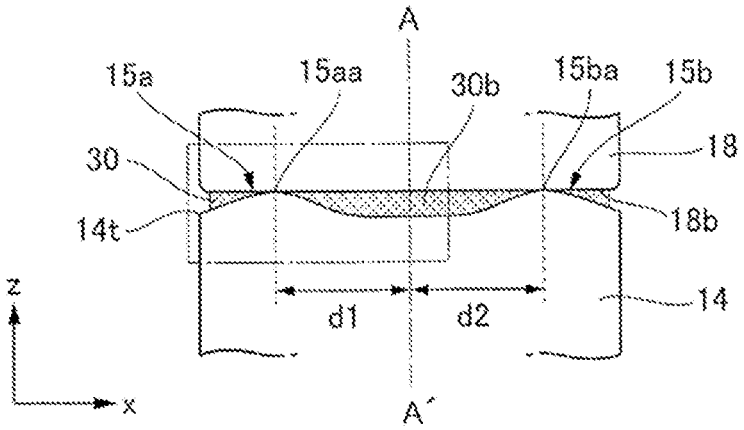
FIG. 7A is a drawing showing an example of bonding surfaces pertaining to the second embodiment.
Figure 7B:
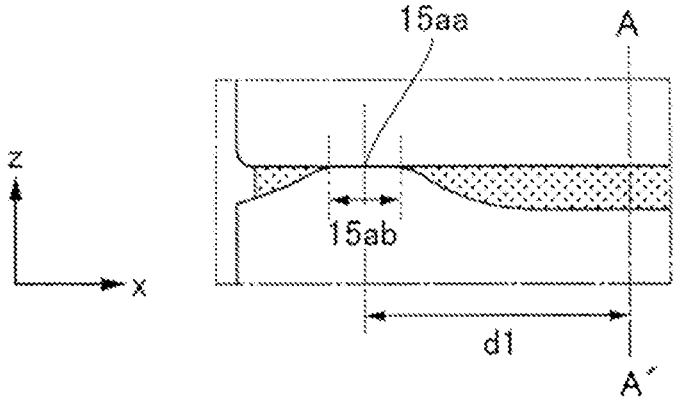
FIG. 7B is an enlarged view of FIG. 7A, showing an example of bonding surfaces pertaining to the second embodiment.

Next, the common mode choke coil pertaining to the second embodiment of the present invention is explained. FIG. 7A shows an example of bonding surfaces on the top face 14*t* of one flange part, and the bottom face 18*b* of the sheet core, of the common mode choke coil 10 pertaining to the second embodiment. FIG. 7B is an enlarged view of the area in FIG. 7A surrounded by the dashed-dotted line. It should be noted that the bonding surface of the top face 14*t* of the other flange part and that of the bottom face 18*b* of the sheet core have the same structure (not illustrated).

As is evident from FIG. 7A, the number and layout of the contact areas 15 between the bonding surfaces are different from the first embodiment shown in FIG. 4. The following explains primarily the differences from the first embodiment. With the common mode choke coil 10 pertaining to this embodiment, those constitutions identical to the corresponding constitutions of the common mode choke coil 10 pertaining to the first embodiment are denoted by the same symbols and are not explained.

The contact areas 15 pertaining to this embodiment include at least two contact areas 15, or specifically a first contact area 15*a* and a second contact area 15*b*. Between the first contact area 15*a* and the second contact area 15*b* is a first adhesive area 30*b*. In this embodiment, the first contact area 15*a* has a contacting region 15*ab* of the flange part 14 and the sheet core 18, as shown in FIG. 7B. The shape of the contacting region 15*ab* is not limited in any way, and it may be a roughly planar or arc-shaped curved surface, etc., for example. When the contacting region 15*ab* is an arc-shaped curved surface, this arc-shaped curved surface contacts linearly (makes line contact) with the bottom face 18*b* of the sheet core on the bonding surface. It should be noted that, similarly, the second contact area 15*b* also has a contacting region of the flange part 14 and the sheet core 18 (not illustrated). Furthermore, the first contact area 15*a* has a first contact-area center point 15*aa* representing the center of the contacting region 15*ab* in the x-axis direction. Similarly, the second contact area 15*b* has a second contact-area center point 15*ba* representing the center of the contacting region in the x-axis direction. The distance d1, in the x-axis direction, from the first contact-area center point 15*aa* to the center axis of flange part A-A' representing the center axis of the top face 14*t* of the flange part, is at least 0.25 times the width of the x-axis direction side of the top face 14*t* of the flange part. Similarly, in the second contact area 15*b*, the distance d2, in the x-axis direction, from the second contact-area center point 15*ba* to the center axis of flange part A-A' is at least 0.25 times the width of the x-axis direction side of the top face 14*t* of the flange part. More preferably the ratio of the distance from the first contact-area center point 15*aa*, and the distance from the second contact-area center point 15*ba*, to the center axis of flange part A-A' in between, is 0.7 or more but no more than 0.9. A greater distance between the two contact points improves the dynamic stability of the flange part 14 and the sheet core 18 owing to their position relationship when pressure is applied.

According to this embodiment, the bonding surfaces on the top face 14*t* of one flange part and the bottom face 18*b* of the sheet core contact each other via two or more areas, and their respective contact-area center points 15*aa*, 15*ba* have specified distances d1, d2 between them over the rough center part of the bonding surfaces, and this constitution achieves stable bonding, and thus stable bonding strength, of the common mode choke coil 10 owing to its shape. Also, the effective adhesive area is larger and the bonding strength is greater over the entire bonding surfaces compared to a conventional common mode choke coil with adhesive applied over the entire surfaces. In other words, the common mode choke coil 10 in this embodiment has improved/stable bonding strength. Furthermore, the common mode choke coil 10 in this embodiment, because of its constitution to have the first adhesive area 30*b*, offers superior inductance characteristics compared to a conventional common mode choke coil with adhesive 30 applied over the entire surfaces, as any negative effect of varying magnetic gaps due to the adhesive layer is reduced.

It should be noted that, while FIGS. 7A and 7B explained this embodiment with a focus on the x-axis direction of the bonding surfaces, this embodiment is not limited in scope to the x-axis direction and, for example, the bonding surfaces may also be constituted as above in the y-axis direction, to achieve the same effects (not illustrated). In other words, it suffices that the multiple contact areas 15 include at least a first contact area 15*a* and a second contact area 15*b* on the top face 14*t* of each flange part, that there is a specified distance from the center of the first contact area to the center of the second contact area in a cross-section which is orthogonal to the top face 14*t* of the flange part and passing through the center of the first contact area and the center of the second contact area, and that the center axis of the cross-section exists within this distance (not illustrated). It should be noted that the center axis of the cross-section represents the center axis of the cross-section in the direction extending from the center of the first contact area toward the center of the second contact area. The aforementioned effects are achieved by this constitution.

<Manufacturing Method>

The following explains an example of how the common mode choke coil 10 proposed by the present invention is manufactured. It should be noted, however, that the present invention is not limited to the example described below.

For the magnetic material of the drum core 16 and sheet core 18, a Ni—Zn ferrite material is used, for example. The magnetic permeability (μ) of the magnetic material only needs to be between 400 and 1000. First, the Ni—Zn ferrite material is mixed with a binder and the mixture is compression-molded into a drum shape using molding dies. Here, preferably the fill ratio of magnetic material is different between the flange part 14 and the sheet core 18. When the flange part 14 and sheet core 18 have rounded corners, as shown in FIG. 3B, adjusting the radius dimensions becomes easy if the fill ratio of magnetic material is different between the flange part 14 and the sheet core 18. Furthermore, preferably the fill ratio of magnetic material of the sheet core 18 and that of the shaft part 12 are higher than the fill ratio of magnetic material of the flange part 14. This way, the mechanical strength can be increased and the common mode choke coil 10 can be made smaller.

Next, as necessary, the surface of the molding is ground to the required surface roughness Ra or surface waviness Wa. The grinding method, abrasive agent, etc., are not limited in any way, and any prior art may be used as deemed appropriate. From the viewpoint of controlling the surface roughness Ra or surface waviness Wa, preferably the grinding is performed using an automatic grinding machine, etc., for example. It should be noted that a step to increase the surface roughness Ra or surface waviness Wa of the molding by means of grinding may also be implemented. It should also be noted that, because the molding often has molding burrs, the burrs are removed by means of barreling, etc., for example. Agitation using an abrasive agent, or sandblasting, may be used. Preferably the surface roughness Ra of the bonding surface of the sheet core 18 is lower than the surface roughness Ra of the bonding surface of the flange part 14. Now, the drum core 16 has a more complex shape compared to the sheet core 18, so it has more burrs and thus requires more barreling. For this reason, the side of the molding having a higher surface roughness Ra can be used for the drum core 16, while the side having a lower surface roughness Ra can be used as the sheet core 18, so that a common mode choke coil 10 that can be produced affordably and offers excellent electrical characteristics, can be obtained.

Thereafter, the molding is sintered at the required sintering temperature to obtain a magnetic body that constitutes a drum core 16 having a shaft part 12 and flange parts 14. Similarly, a sheet core 18 is also molded into a sheet shape using dies, and sintered.

Thereafter, an Ag paste is roller-transferred onto specified areas of the flange parts 14 and then thermally treated, and plated with Ni and Sn, to form electrode terminals 22*a*. For example, Ni plating and Sn plating are combined to form electrode terminals 22*a* with a thickness of approx. 10 μm. Then, sheathed conductive wires 28 are wound around the outer periphery of the shaft part 12, to form a coil-shaped conductor 20. For the sheathed conductive wires 28, UEWs (polyurethane copper wires) of Ø50 μm may be used, for example. Here, preferably the surface roughness Ra of the shaft part 12 is lower than the surface roughness Ra of the flange part. This way, any negative effect of the surface irregularities of the shaft part 12 can be reduced and the sheathed conductive wires 28 can be wound in a stable state. Thereafter, the drum core 16 and sheet core 18 are bonded at their bonding surfaces, and the adhesive 30 is cured under pressure. The bonding method is explained below.

Figure 8:
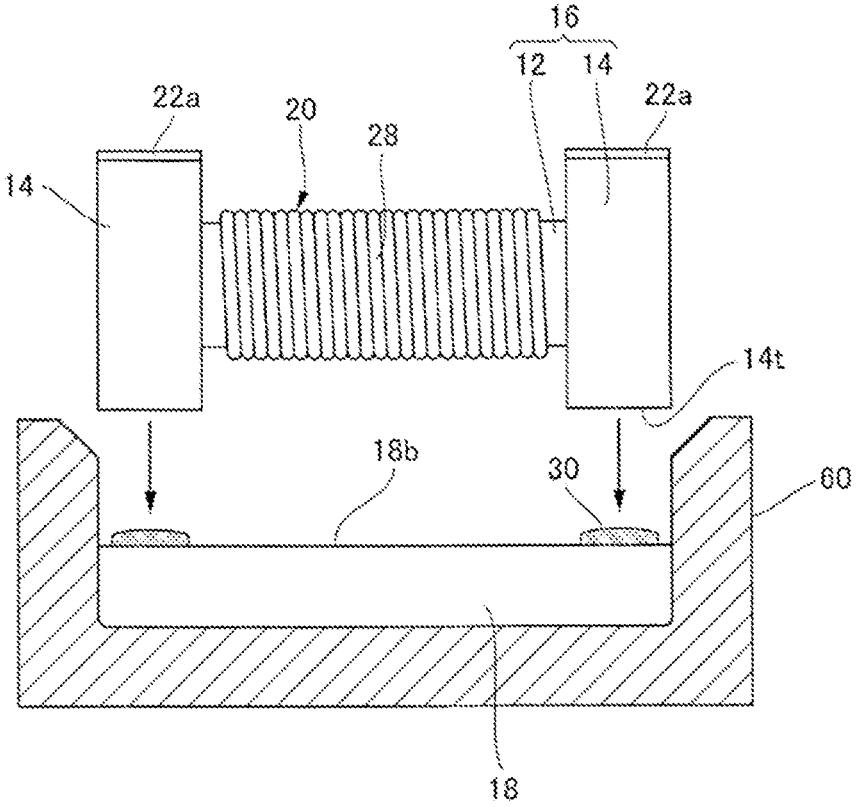
FIG. 8 is a drawing explaining an example of a bonding method as part of the manufacturing method.

FIG. 8 is a drawing explaining an example of a bonding method as part of the manufacturing method. When the drum core 16 is bonded with the sheet core 18, first the sheet core 18 is stored inside a jig 60 with the bottom face 18*b* of the sheet core facing up, after which an adhesive 30 is applied by a specified amount using a dispenser, etc., at specified positions on the bottom face 18*b* of the sheet core, as shown in FIG. 8. The inner diameter dimension of the jig 60 is effectively equal to the external dimension of the sheet core 18, so the sheet core 18 is secured as the sheet core 18 is stored inside the jig 60. The jig 60 is not limited to any particular shape, so long as it has an opening in which the sheet core 18 can be stored. The material of the jig 60 is not limited in any way, either. Thereafter, the top faces 14*t* of the flange parts are adhered to the specified positions on the bottom face 18*b* of the sheet core where the adhesive 30 has been applied.

For the adhesive 30, an epoxy (specification having a grass transition temperature Tg of 125° C.) may be used, for example. The application amounts and application positions of the adhesive 30 are adjusted in such a way that, when the top faces 14*t* of the flange parts are adhered to the bottom face 18*b* of the sheet core, the compressed adhesive 30 will not ooze out of the edges of the top faces 14*t* of the flange parts and the adhesive 30 will reach the outer lines of the bottoms of the adhesive areas 30*a*, 30*b*. Also, with a constitution where the bottom face 18*b* of the sheet core has grooves 40, as is the case in the variation example shown in FIG. 5, the application amounts of adhesive 30 are adjusted to not exceed the volumes of the grooves 40, and the application amounts and positions are adjusted so that the compressed adhesives 30*c* will reach the grooves 40. The respective dimensions of the drum core 16, sheet core 18, and jig 60 are controlled, and by handling the drum core 16 and the sheet core 18 as they are bonded together and by also positioning the adhesive 30 entirely inside the jig 60, the number of times the product is handled can be reduced compared to when any prior art is used. In addition, magnetic gaps that generate between the drum core 16 and the sheet core 18 can be minimized regardless of the sizes and weights of the drum core 16 and sheet core 18. Particularly when a small, lightweight drum core 16 is used, its movement, and consequent shifting, can be prevented as the adhesive 30 is cured. Thereafter, the adhesive 30 is thermally cured while pressure is applied according to the below-mentioned pressurization method, to bond the drum core 16 and the sheet core 18. The pressurization method is explained below.

Figure 9:
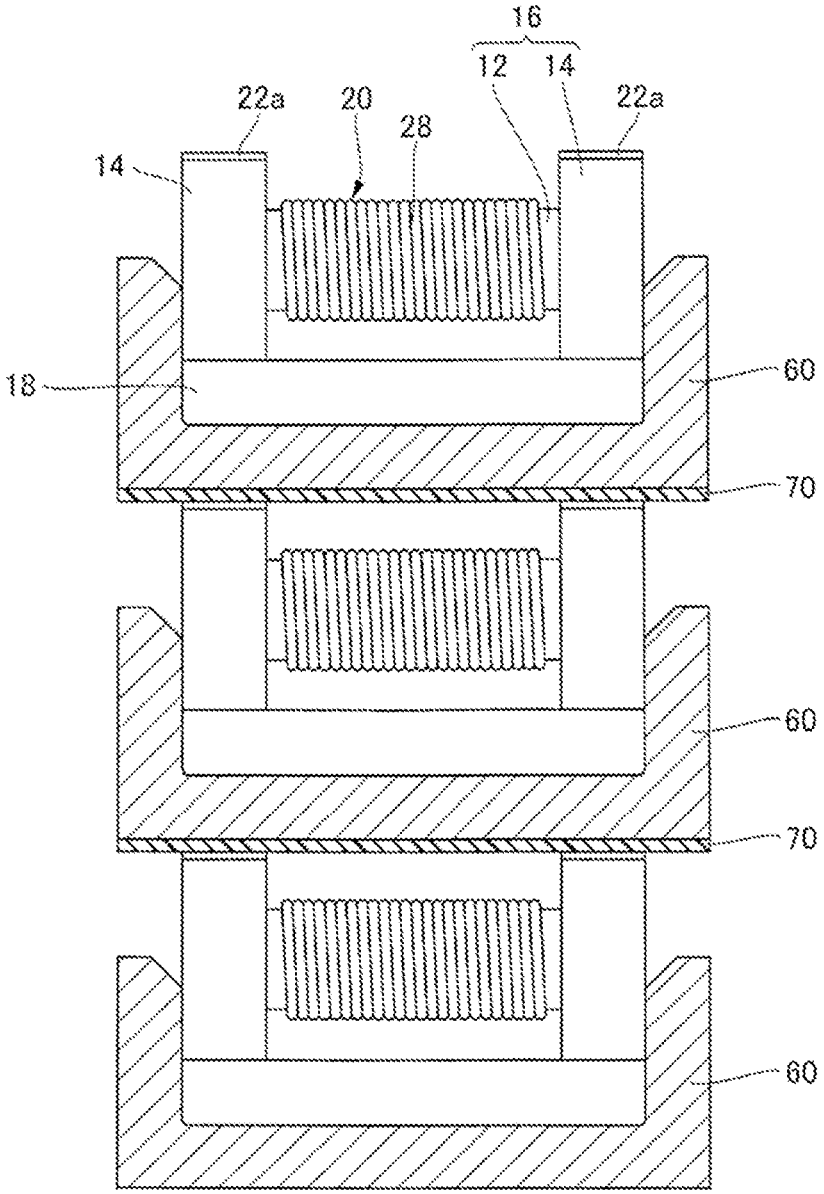
FIG. 9 is a drawing explaining an example of a pressure method as part of the manufacturing method.

FIG. 9 is a drawing explaining an example of a pressurization method as part of the manufacturing method. As shown in FIG. 9, multiple jigs 60, each storing a product, are stacked and the adhesive 30 is thermally cured while pressure is applied with a thermal press. A curing temperature is selected according to the glass transition temperature Tg of the adhesive. Preferably this temperature is higher than the glass transition temperature Tg, but no higher than Tg+50° C. Since the adhesive is cured under pressure, the positions of the drum core 16 and sheet core 18, as they are bonded, do not shift but remain stable in the vertical direction. A flexible sheet 70 is provided at the bottom of each jig 60. The sheet 70 may be a synthetic rubber or silicone rubber sheet, for example, but other sheet may be used so long as it has the flexibility to apply pressure to the products almost uniformly without damaging the cores, etc., and its shape and material are not limited in any way. By providing a flexible sheet 70 at the bottom of each jig 60, the required bonding pressure can be applied to each individual product inside the jigs 60 where multiple products are arranged, and the uncured adhesive 30 can be spread uniformly and thinly. The specific pressure required is between 0.1 MPa and 1 MPa in equivalent pressure relative to the area of contact. During manufacture, pressure can be applied to multiple products all at once using a heat press. Presence of the contact areas 15 eliminates the need to finely control the required pressure per product, compared to when a prior art without contact areas 15 is used. This is because the contact areas 15 prevent the bonding thickness from decreasing further. Furthermore, the adhesive 30 can be cured in a uniformly and thinly spread state, which reduces the negative effect of magnetic gaps which would otherwise generate due to the amount of adhesive 30 becoming uneven in some areas and thus the thickness of the adhesive layer becoming uneven; and consequently, a common mode choke coil 10 offering excellent inductance characteristics can be obtained. In addition, implementing the main curing inside the jig 60 prevents the product from moving while the adhesive 30 is cured. Furthermore, implementing the main curing inside the jig 60 makes a transfer step unnecessary, compared to when a prior art is used that requires a separate main curing step after a preliminary curing, and this ensures high productivity while also reducing damage the product would otherwise suffer due to transfer.

The common mode choke coil 10, thus obtained, is mounted in an electronic component, etc., with the electrode terminals 22*a* soldered to a circuit board.

To give an example of external dimensions of the common mode choke coil 10 thus obtained, the product size is 3.2 mm in length, 2.5 mm in width, and 2.5 mm in height. Also, the dimensions of the drum core 16 are such that its external shape is 2.9 mm long, 2.5 mm wide, and 2.1 mm high. Its shaft part 12 is 1.1 mm wide and 0.8 mm high, while its flange parts 14 are each 0.3 mm thick. In addition, the sheet core 18 has an external shape of 3.2 mm in length, 2.5 mm in width, and 0.4 mm in height. Also, in the case of the variation example shown in FIG. 6, the side grooves are each 0.3 mm wide and 0.2 mm deep.

The foregoing explained several embodiments of the present invention; however, these embodiments were presented only as examples and they are not intended to limit the scope of the invention. Various changes can be added to these embodiments so long as doing so does not deviate from the key points of the present invention. For example, the shapes and external dimensions shown in the aforementioned embodiments are only examples, and may be changed as necessary and deemed appropriate. Also, the materials of the respective parts shown in the aforementioned embodiments are also examples, and various known materials may be used instead. Furthermore, the manufacturing procedure shown in the aforementioned example is also an example, and may be changed as deemed appropriate to the extent that the same effects can be achieved. Moreover, the common mode choke coil 10 proposed by the present invention is favorably used in mobile devices such as onboard devices that require impact resistance, or high-frequency components of such devices; however, it can also be applied to all other known applications.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. A bonding structure of a sheet core and a pair of flange parts wherein the pair of flange parts are formed on both ends of a shaft part to constitute a drum core together with the shaft part around which sheathed conductive wires are wound as a coil; and the sheet core is bonded, in a manner connecting the pair of flange parts across the shaft part, to top faces of the flange parts facing away from bottom faces of the flange parts to be mounted on a circuit board, wherein each of the flange parts has a bonding surface with the sheet core where each flange part is bonded to the sheet core, wherein the bonding surface of at least one of the flange parts has: (i) multiple contact areas along the bonding surface as viewed in a direction where the flange part makes direct contact with the sheet core, and (ii) adhesive areas, which are not part of the multiple contact areas, along the bonding surface as viewed in the direction where an adhesive is disposed between the flange part and the sheet core, wherein the multiple contact areas and the adhesive areas are, respectively, arranged alternately along the bonding surface as viewed in the direction, wherein a surface waviness of the bonding surface of the sheet core is smaller than a surface waviness of the bonding surface of the flange part, and the surface waviness of the bonding surface of the flange part is 25 μm or less.

2. A bonding structure of a sheet core and a pair of flange parts wherein the pair of flange parts are formed on both ends of a shaft part to constitute a drum core together with the shaft part around which sheathed conductive wires are wound; and the sheet core is bonded, in a manner connecting the pair of flange parts across the shaft part, to top faces of the flange parts facing away from bottom faces of the flange parts to be mounted on a circuit board, wherein bonding surfaces of each of the flange parts and the sheet core have: (i) multiple contact areas where the flange part makes direct contact with the sheet core, and (ii) adhesive areas between the contact areas where an adhesive is disposed, wherein:

the multiple contact areas include a first contact area and a second contact area, and the adhesive areas include a first adhesive area positioned between the first contact area and the second contact area; and when a center of a contacting region of the flange part and the sheet core in the first contact area in a circumferential direction of the coil-shaped conductor positioned in parallel with a bottom face of the flange part is defined as a first contact-area center point, a center of a contacting region of the flange part and the sheet core in the second contact area in a circumferential direction of the coil-shaped conductor positioned in parallel with a bottom face of the flange part is defined as a second contact-area center point, and a widthwise center line of a top face of the flange part in a circumferential direction of the coil-shaped conductor positioned in parallel with a bottom face of the flange part is defined as a center line of the flange part, a distance from the first contact-area center point to the center line of flange part, and a distance from the second contact-area center point to the center line of flange part, in the circumferential direction of the coil-shaped conductor positioned in parallel with the bottom face of the flange part, are both at least 0.25 times a width of a side on the top face of the flange part in the circumferential direction of the coil-shaped conductor positioned in parallel with the bottom face of the flange part.

3. The bonding structure according to claim 2, wherein the first adhesive area is positioned roughly at a center of the top face of the flange part in the circumferential direction of the coil-shaped conductor positioned in parallel with the bottom face of the flange part.

4. The bonding structure according to claim 1, wherein an external dimension of the sheet core in an axial direction of the coil-shaped conductor is greater than an external dimension of the drum core in a length direction.

5. A bonding structure of a sheet core and a pair of flange parts wherein the pair of flange parts are formed on both ends of a shaft part to constitute a drum core together with the shaft part around which sheathed conductive wires are wound; and the sheet core is bonded, in a manner connecting the pair of flange parts across the shaft part, to top faces of the flange parts facing away from bottom faces of the flange parts to be mounted on a circuit board, wherein bonding surfaces of each of the flange parts and the sheet core have: (i) multiple contact areas where the flange part makes direct contact with the sheet core, and (ii) adhesive areas between the contact areas where an adhesive is disposed, wherein a rounded shape is formed at a corner of the bonding surface of the flange part, and in an axial direction of the coil-shaped conductor, and a difference between an external dimension of the sheet core and that of the drum core is greater than a radius dimension of the rounded shape at the flange part.

6. The bonding structure according to claim 1, wherein the bonding surface is away from the sheathed conductive wires.

7. The bonding structure according to claim 6, wherein side faces joined to the bottom faces of the flange parts have side grooves, and electrode terminals are positioned inside the side grooves of the flange parts.

8. The bonding structure according to claim 1, wherein a surface roughness of the bonding surface of the sheet core is lower than a surface roughness of the bonding surface of the flange part.

9. The bonding structure according to claim 1, wherein a groove is formed in either the bonding surface of the flange part or that of the sheet core, and a volume of a cured adhesive on the bonding surface is smaller than a volume of the groove.

10. The bonding structure according to claim 1, wherein a surface roughness of the shaft part is lower than a surface roughness of the flange part.

11. The bonding structure according to claim 1, wherein a fill ratio of magnetic material of the sheet core and that of the shaft part is higher than a fill ratio of magnetic material of the flange part.

12. The bonding structure according to claim 1, wherein an external dimension of the sheet core in an axial direction of the coil-shaped conductor is 3.2 mm or less.

13. A method for producing the bonding structure of claim 1, comprising:

a step to form a drum core and a sheet core, wherein the drum core has the shaft part and the pair of flange parts;

a step to wind the sheathed conductive wires around the drum core to form a coil-shaped conductor;

a step to connect both ends of the sheathed conductive wires and the electrode terminals; and a step to apply the adhesive to the sheet core on a jig, install the drum core on the sheet core to which the adhesive has been applied, and stack the jig on which the drum core has been installed with other such jigs, and thereby apply pressure while the adhesive is cured, wherein the bonding surface of at least one of the flange parts is bonded to the sheet core at the multiple contact areas and the adhesive areas of the bonding surface, wherein a surface waviness of the bonding surface of the sheet core is smaller than a surface waviness of the bonding surface of the flange part, and a surface waviness of the bonding surface of the flange part is 25 μm or less.

* * * * *